United States Patent [19]

DeSantis et al.

[11] Patent Number: 4,938,666

[45] Date of Patent: Jul. 3, 1990

[54] STAGED UNLOADING OF CYLINDER BANK

[75] Inventors: John J. DeSantis, Dewitt; Bruce A. Fraser, Manlius; Peter F. Kaido, West Leyden, all of N.Y.

[73] Assignee: Carrier Corporation, Syracuse, N.Y.

[21] Appl. No.: 237,356

[22] Filed: Aug. 29, 1988

[51] Int. Cl.[5] ..... F04B 49/02

[52] U.S. Cl. ..... 417/295; 417/286; 417/287; 417/288; 417/428

[58] Field of Search ..... 417/428, 485, 503, 504, 417/279, 283, 285, 288, 295, 419, 415, 426, 539, 53, 427, 286, 287

[56] References Cited

U.S. PATENT DOCUMENTS 2,555,004 5/1951 Rinehart ..... 417/288

4,382,749 5/1983 Teegarden et al. ..... 417/415

*Primary Examiner*—Leonard E. Smith

*Assistant Examiner*—John A. Savio, III

*Attorney, Agent, or Firm*—David J. Zobkiw

[57] ABSTRACT

In a compressor having a plurality of banks of cylinders, smaller steps of unloading are achieved by unloading a single cylinder in a bank. When only one cylinder is to be unloaded, gas bypass is used in order to maintain a closer balance of forces in the bank. When the entire bank is unloaded, it is preferably done via the suction cutoff method.

10 Claims, 7 Drawing Sheets

STAGED UNLOADING OF CYLINDER BANK

BACKGROUND OF THE INVENTION

In four and six cylinder semi-hermetic reciprocating compressors used in refrigeration and air conditioning applications it is common to locate the cylinders in pairs or banks with the two cylinders in each bank 180° out of phase with each other. The cylinders of each bank would have a common suction and discharge manifold structure. As a result, a single actuator is used to unload an entire bank of cylinders at the same time. However, because the cylinders are paired, there is a large increment of unloading. Specifically, the unloading steps are 50% for a four cylinder compressor and 33% for a six cylinder compressor. It is desirable to be able to have smaller steps of unloading by unloading a single cylinder at a time. There are certain difficulties associated with the unloading of one cylinder of a bank.

Suction cutoff is the preferred method of unloading and it effectively transforms a cylinder from acting as a compressor to acting like a vacuum pump. In acting as a vacuum pump, there is a comparatively significant amount of input work done on what was the suction stroke since the cylinder is drawn into a vacuum. The vacuum then provides an assist for a large portion of the revolution on what was the compression stroke. As a result, both cylinders of the bank have an overlapping work stroke rather than being 180° out of phase since the discharge stroke of the compressor cylinder is paired with the suction stroke of the vacuum pump cylinder. When unloading one cylinder of a bank by suction cutoff, the result is a significant surge in the RPM at the completion of the work stroke which produces unacceptable machine vibrations.

Gas bypass is an alternative method of unloading a compressor and involves the direct return from the discharge side of the cylinder head to suction. Because some work is being done in the compression of the gas and because the cylinder is not acting as a vacuum pump, the bank remains more closely balanced although some of the work is otherwise unnecessary. Additionally, there is a heating of the gas since it is being partially compressed and then directly returned to suction rather than passing through the refrigeration equipment.

SUMMARY OF THE INVENTION

A single cylinder of a bank of cylinders is unloaded by gas bypass so that the cylinders remain closely balanced from a work stand point. The suction manifold is common for all of the cylinders in the bank so that the heat buildup due to the hot gas bypass is mitigated. Because suction cutoff is more efficient, when it is desired to unload the entire bank, it is done by suction cutoff.

It is an object of this invention to provide a greater degree of capacity control in a compressor having banked cylinders.

It is another object of this invention to minimize vibration and efficiency loss when unloading a single cylinder of a bank. These objects, and others as well become apparent hereinafter, are accomplished by the present invention.

Basically, two methods of unloading are applied to a bank of cylinders. When a single cylinder is unloaded, it is achieved by gas bypass. However, when the entire bank is unloaded, it is achieved by suction cutoff.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
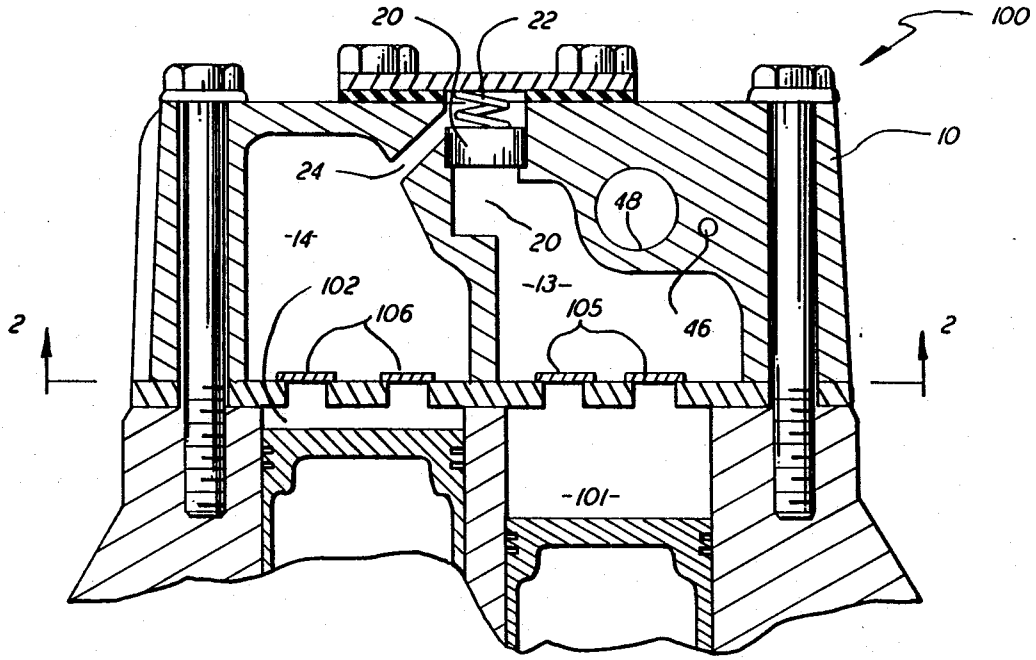
FIG. 1 is a partial sectional view taken along line 1—1 of FIG. 2 of one bank of a compressor employing the present invention.

In the Figures, the numeral 10 generally designates the cylinder head for one bank of a multi-bank reciprocating compressor 100. Cylinder head 10 is divided into six chambers, 11–16, of which chambers 11–14 are visible in FIG. 2. Under all circumstances of operation, chamber 11 is in fluid communication with the suction manifold (not illustrated) and chamber 14 is in fluid communication with the discharge manifold (not illustrated).

Chamber 11 is in fluid communication with chamber 12 under the control of piston valve 30. Chamber 13 is always in fluid communication with the discharge side of cylinder 101 of the bank and can communicate with chamber 12 via bypass port 18 under the control of piston valve 40 or with chamber 14 via port 20 under the control of check valve 50, or chamber 13 can be isolated from the other chambers by check valve 50 and piston valve 40. Piston valves 30 and 40 are controlled, respectively, by solenoid valves 60 and 70 as will be explained in greater detail below.

Figure 2:
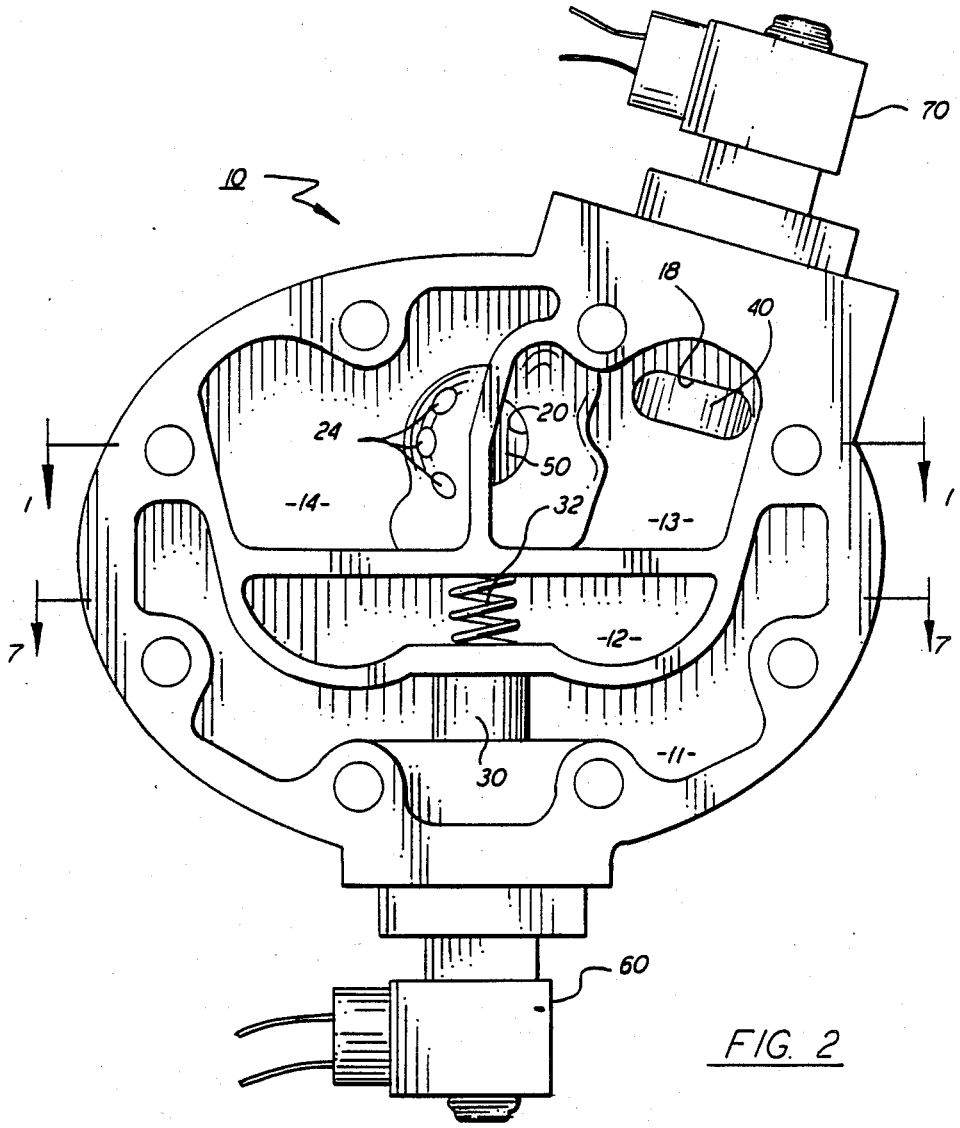
FIG. 2 is a bottom view taken along line 2—2 of FIG. 1 of a cylinder head made according to the teachings of the present invention with both cylinders of the bank unloaded.
Figure 3:
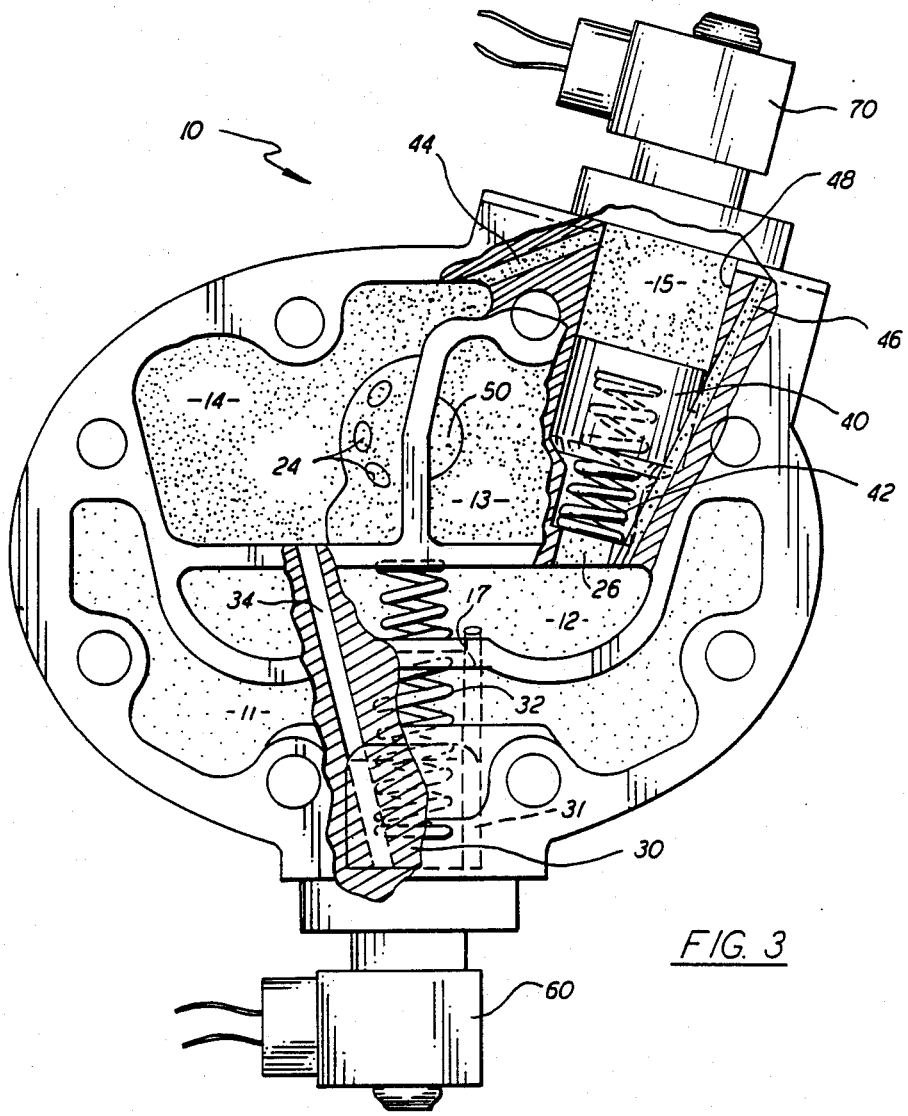
FIG. 3 is a partially cutaway bottom view of the cylinder head of FIG. 2 showing the fully loaded position of the members.
Figure 4:
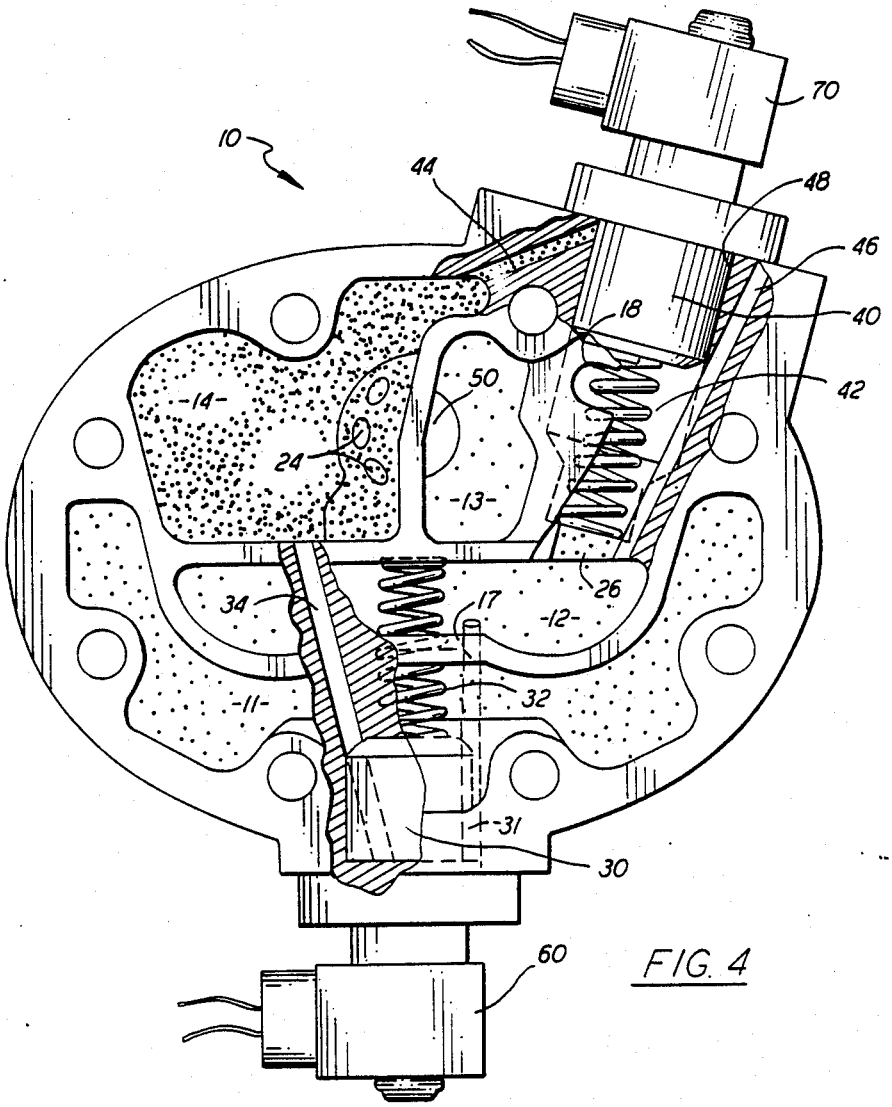
FIG. 4 is a partially cutaway bottom view of the cylinder head of FIG. 2 showing the position of the members when one cylinder of the bank is unloaded.
Figure 5:
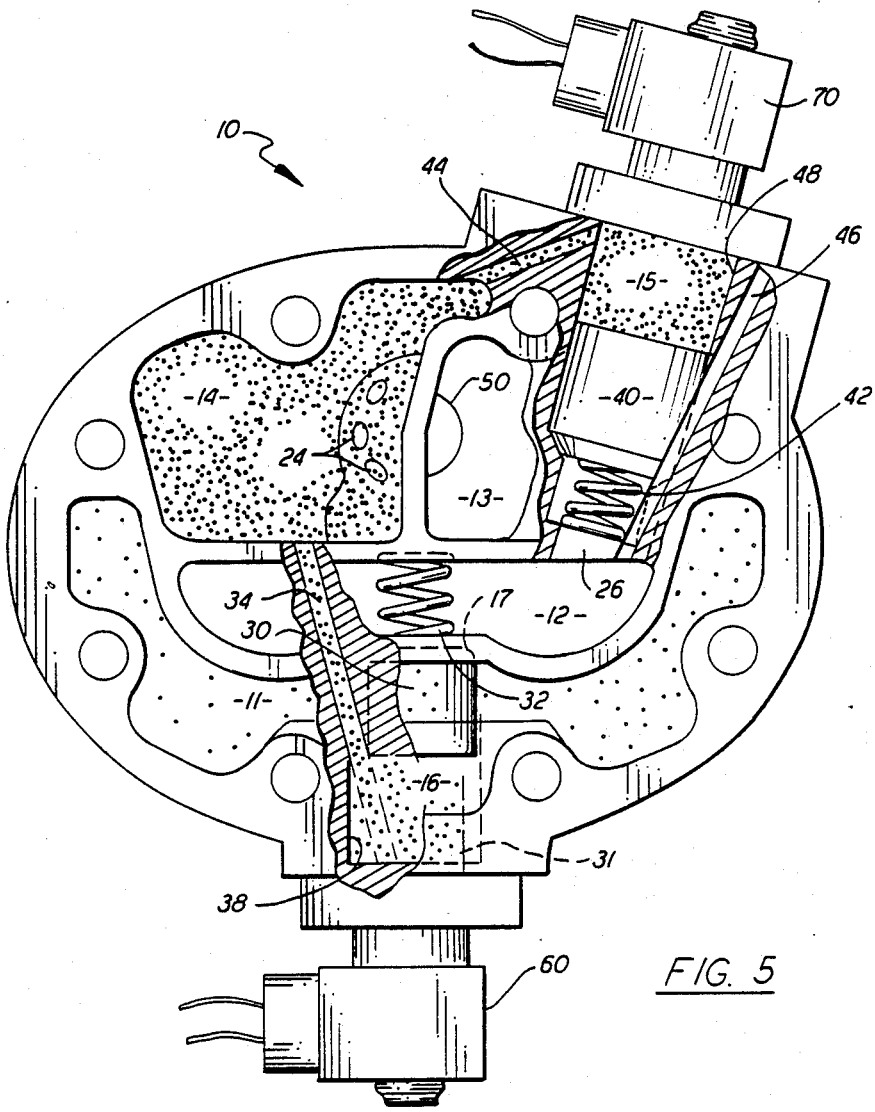
FIG. 5 is a partially cutaway bottom view of the cylinder head showing the position of the members with both of the cylinders unloaded as illustrated in FIG. 2.
Figure 6:
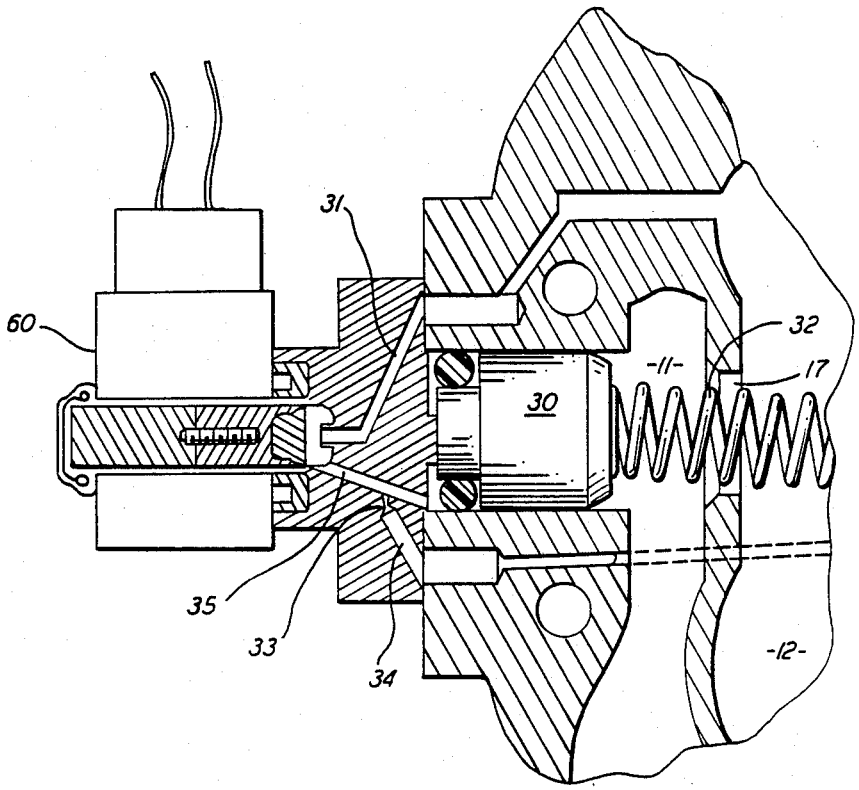
FIG. 6 is a sectional view of a solenoid valve assembly.
Figure 7:
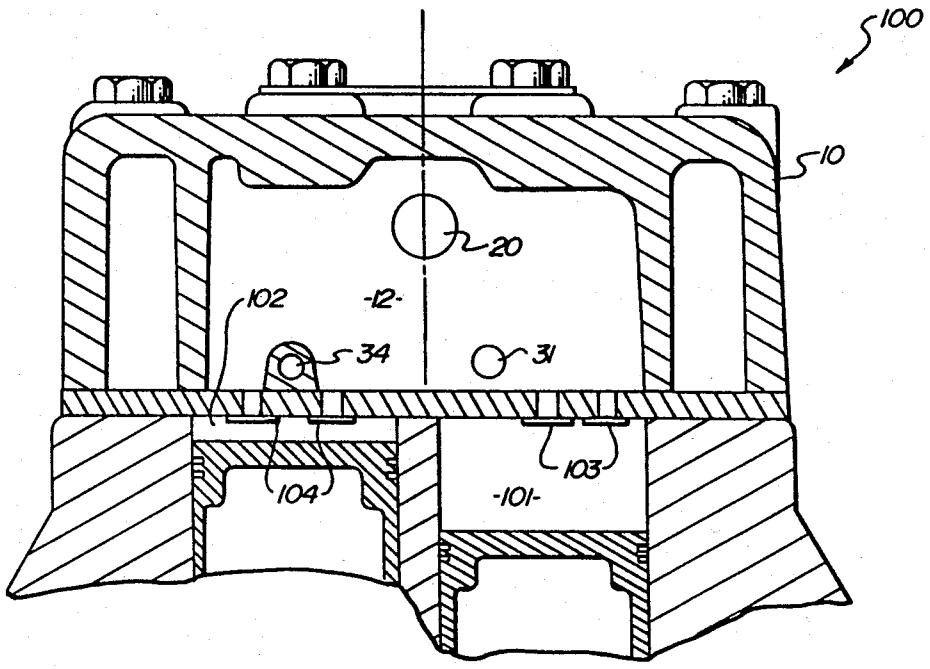
FIG. 7 is a sectional view taken along line 7—7 of FIG. 2.

Referring now to FIGS. 3–5, it will be noted that a portion of the FIG. 2 structure has been cut away in order to show various fluid paths and other structures as well as the relative positions of the various members. Additionally, the chambers at suction and discharge pressure have been indicated by stippling of appropriate intensity. Referring specifically to FIGS. 3 and 6, it will be noted that solenoid valve 60 is open so that high pressure communicated via high pressure passage 34, bleed orifice 33 and passage 35 is not allowed to build up behind piston valve 30. This is due to the establishment of fluid communication of passage 35 with chamber 11 via passage 31 when solenoid valve 60 is open. This permits spring 32 to maintain piston valve 30 in its normally open position permitting fluid communication between chambers 11 and 12 via port 17. When solenoid valve 60 is closed, as illustrated in FIG. 5, passage 31 is blocked and high pressure from chamber 14 communicates with piston valve 30 via passage 34, bleed orifice 33 and passage 35 and moves piston valve 30 against the bias of spring 32 thereby blocking port 17. Solenoid valve 70, which operates in the same manner as solenoid valve 60 and is structurally identical, is closed so that high pressure from chamber 14 is communicated to chamber 15 via high pressure passage 44 which corresponds to passage 34 and acts on piston valve 40 causing it to move against the bias of spring 42 and the pressure in chamber 12 which is acting on the other side of piston valve 40. In the FIG. 3 position, piston valve 40 blocks bypass port 18. Low pressure passage 46 which corresponds to passage 31 provides fluid communication between chamber 12 and the high pressure gas trapped behind piston valve 40 and thereby allows valve 40 to move in the manner of valve 30 when solenoid valve 70 is energized. The FIG. 3 position represents the full load position in which both cylinders of the bank covered by cylinder head 10 are delivering compressed gas to the discharge manifold.

In operation of the FIG. 3 configuration, gas is drawn in from the suction manifold (not illustrated) and passes into chamber 11 and then via port 17 into chamber 12 since spring 32 keeps valve 30 open as long as solenoid valve 60 is open. Chamber 12 is in fluid communication with both of the cylinders, 101 and 102, of the bank via their respective suction valves 103 and 104. Chambers 13 and 14 are in fluid communication with cylinders 101 and 102, respectively, of the bank via their respective discharge valves 105 and 106. Chamber 14 is in fluid communication with the discharge manifold (not illustrated), high pressure passage 34 and with high pressure passage 44 which, since solenoid valve 70 is closed, communicates with piston valve bore 48 which defines chamber 15. The high pressure in chamber 15 keeps piston valve 40 in a position blocking bypass port 18. The gas discharged into chamber 13, as best shown in FIG. 2, communicates with check valve 50 via port 20 such that it opens valve 50 against the bias of spring 22 permitting fluid communication from chamber 13 to chamber 14 via ports 20 and 24 and via chamber 14 to the discharge manifold. Because the flow is from chamber 13 to chamber 14, the pressure in chamber 13 must be higher at that time but this is, in part, a natural consequence of the two cylinders of the bank being 180° out of phase so that discharge is only taking place from one of the two cylinders of the bank at any time and only the discharging cylinder is at a slightly higher than compressor discharge pressure. Other than the fact that there is additional structure, as described, the operation of the device in the FIG. 3 position is generally conventional for a fully loaded bank.

FIG. 4 represents the situation where the cylinder 101 discharging into chamber 13 is unloaded by gas bypass. In the FIG. 4 position, solenoid valves 60 and 70 are powered so that spring 32 opens piston valve 30 permitting fluid communication between chambers 11 and 12 via port 17 while spring 42 opens piston valve 40 permitting fluid communication between chambers 13 and 12 via bypass port 18, bore 48 and port 26.

In operation of the FIG. 4 configuration, gas is drawn in from the suction manifold (not illustrated) and passes into chamber 11 and then via port 17 into chamber 12 since spring 32 keeps valve 30 open as long as solenoid valve 60 is open. Chamber 12 is in fluid communication with both of the cylinders of the bank via their respective suction valves 103 and 104. Chambers 13 and 14 are in fluid communication with cylinders 101 and 102, respectively, of the bank via their respective discharge valves 105 and 106. Chamber 14 is in fluid communication with the discharge manifold (not illustrated), high pressure passage 34 and with high pressure passage 44. With solenoid valve 70 open, spring 42 positions piston valve 40 such that bypass port 18 is uncovered. As a result, gas discharged into chamber 13 passes through bypass port 18, bore 48 and port 26 into chamber 12 from which it can be drawn into both cylinders together with additional gas supplied from the suction manifold as previously described. Because the gas discharged into chamber 13 mixes with the other suction gas and the mixture is supplied to both cylinders, typical heating of the suction gas due to gas bypass is mitigated. Because chamber 13 is in fluid communication with the suction structure it is at a reduced pressure relative to chamber 14 and spring 22 keeps check valve 50 closed to thereby isolate chambers 13 and 14 from each other. Cylinder 102, which is connected to chamber 14, operates in a normal fashion and the discharged gas passes from chamber 14 to the discharge manifold. By using gas bypass to unload the cylinder 101, both cylinders have an out-of-phase working stroke with no deep vacuum. Thus, the bank remains more closely balanced. Although better balance is obtained, cylinder 101, which is unloaded, provides no useful work.

FIG. 5 represents the situation where both of the cylinders in the bank are unloaded and may be achieved from either the fully loaded position of FIG. 3 or the single unloaded cylinder position of FIG. 4. In the FIG. 5 position solenoid valve 60 is de-energized so that it is closed permitting high pressure fluid to pass from chamber 14 via high pressure passage 34 into chamber 16 defined by bore 38 where it acts on piston valve 30 in opposition to the bias of spring 32 shifting valve 30 to close port 17 and thereby isolating chamber 12 from the suction manifold. This has the ultimate effect of unloading both cylinders of the bank by suction cutoff. However, depending upon whether or not solenoid valve 70 is powered and opened, the cylinder discharging into chamber 13 may or may not also be unloaded due to gas bypass. Specifically, if solenoid valve 70 is unpowered and closed as illustrated in FIG. 5, high pressure fluid from chamber 14 will pass via high pressure passage 44 into chamber 15 causing piston valve 40 to shift to a position blocking bypass port 18 thereby placing the cylinder discharging into chamber 13 in an unloaded condition due to suction cutoff. However, if solenoid valve 70 is powered, bypass port 18 will be uncovered placing the cylinder discharging into chamber 13 in the gas bypass condition. Since the gas bypass condition returns the gas to chamber 12 which communicates with the suction side of all of the cylinders of the bank, both cylinders will ultimately be unloaded due to suction cutoff.

Thus, in operation in the FIG. 5 configuration the closing of solenoid 60 causes piston valve 30 to be shifted to block port 17 thereby isolating chamber 12 from the suction manifold. This causes the bank to be unloaded due to suction cutoff. However, if bypass port 18 is open because solenoid valve 70 is open, the cylinder discharging into chamber 13 will be physically in the gas bypass condition but the bypassed gas will be ultimately drawn off by the other cylinder from the common chamber 12 which communicates with the suction side of all of the cylinders of the bank. If enough of a vacuum is established in chamber 12, piston valve 40 may be shifted even if valve 70 is not opened, this would take the cylinder discharging into chamber 13 out of the gas bypass condition.

Although a preferred embodiment of the present invention has been illustrated and described, other modifications will occur to those skilled in the art. It is therefore intended that the present invention is to be limited only by the scope of the appended claims.

What is claimed is:

1. A method for unloading one bank of cylinders in a compressor having a plurality of banks of cylinders to achieve smaller steps of unloading including the steps of:

unloading a first cylinder in the one bank to achieve a first step of unloading;

with only a second cylinder still remaining loaded in the one bank, then unloading the one bank.

2. The method of claim 1 wherein the step of unloading the first cylinder is achieved by gas bypass.

3. The method of claim 1 wherein the step of unloading the one bank causes all of the cylinders in the one bank to be unloaded by suction cutoff.

4. A method for unloading one bank of cylinders in a compressor having a plurality of banks of cylinders to achieve smaller steps of unloading including the steps of:

unloading a first cylinder in the one bank by gas bypass to achieve a first step of unloading;

with only a second cylinder loaded in the one bank and then unloading the one bank by suction cutoff.

5. A method for unloading one bank of cylinders comprising the steps of:

supplying gas to a first chamber which is fluidly connected to the suction side of each cylinder in the one bank;

discharging a first one of the cylinders of the one bank into a second chamber which is adapted to freely communicate with a discharge manifold;

discharging a second one of the cylinders of the one bank into a third chamber;

fluidly connecting the third chamber with the second chamber when the third chamber is at discharge pressure;

fluidly connecting the third chamber to the first chamber to unload the second one of the cylinders by gas bypass.

6. The method of claim 5 further including the step of unloading the first one of the cylinders.

7. The method of claim 5 further including the step of selectively preventing the supplying of gas to the first chamber to cause all of the cylinders of the one bank to be unloaded by suction cutoff.

8. In a compressor having a bank of cylinders with each cylinder of said bank having a suction side and a discharge side, unloading means comprising:

cylinder head means defining first, second and third chambers;

said first chamber being adapted to be in fluid communication with said suction side of each of said cylinders in said bank;

said second chamber being adapted to be in fluid communication with said discharge side of a first one of said cylinders and in free communication with a discharge manifold;

said third chamber being adapted to be in fluid communication with said discharge side of a second one of said cylinders;

check valve means for permitting fluid flow from said third chamber to said second chamber only when said third chamber is at discharge pressure;

means for selectively connecting said third chamber to said first chamber to unload said second one of said cylinders by gas bypass.

9. The unloading means of claim 8 further including means for unloading said first one of said cylinder means by suction cutoff.

10. The unloading means of claim 9 wherein said means for unloading said first one of said cylinder means also unloads said second one of said cylinder means by suction cutoff.

* * * * *